US009460880B2

(12) United States Patent
Melecio Ramirez et al.

(10) Patent No.: US 9,460,880 B2
(45) Date of Patent: Oct. 4, 2016

(54) THERMAL-MECHANICAL FLEXIBLE OVERLOAD SENSOR

(71) Applicant: SCHNEIDER ELECTRIC USA, INC., Palatine, IL (US)

(72) Inventors: Juan Ignacio Melecio Ramirez, Celaya (MX); Waldo Jesus Arcos Medina, Apodaca (MX); Gabriela Isabel Rubio Barraza, Monterrey (MX)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 14/553,131

(22) Filed: Nov. 25, 2014

(65) Prior Publication Data

US 2016/0148771 A1 May 26, 2016

(51) Int. Cl.

| | |
|---|---|
| ***H01H 71/18*** | (2006.01) |
| ***H01H 61/06*** | (2006.01) |
| ***H01H 81/02*** | (2006.01) |
| ***H01H 61/00*** | (2006.01) |
| ***H01H 85/00*** | (2006.01) |
| ***H01H 61/04*** | (2006.01) |

(52) U.S. Cl.

CPC ..... *H01H 61/04* (2013.01)

(58) Field of Classification Search

CPC ..... H01H 23/24; H01H 23/26; H01H 37/00; H01H 37/02; H01H 37/04; H01H 37/32; H01H 61/04

USPC ..... 337/12, 298, 233, 38, 414, 415, 123, 337/125, 137, 142, 186

See application file for complete search history.

(56) References Cited

U.S. PATENT DOCUMENTS

| | | | | |
|---|---|---|---|---|
| 2,322,556 A | | 6/1943 | Herbert | |
| 2,610,271 A | | 9/1952 | Russell | |
| 2,618,716 A | * | 11/1952 | Boller | H01H 71/0214 200/464 |
| 2,978,557 A | * | 4/1961 | Ingwersen | H01H 71/162 337/101 |
| 4,232,282 A | * | 11/1980 | Menocal | H01H 71/0214 335/202 |
| 4,604,596 A | * | 8/1986 | Yokoyama | H01H 89/10 335/14 |
| 4,630,019 A | * | 12/1986 | Maier | H01H 71/7436 335/45 |
| 5,182,532 A | * | 1/1993 | Klein | H01H 71/405 335/167 |
| 5,831,509 A | * | 11/1998 | Elms | H01H 71/125 335/35 |
| 5,864,266 A | * | 1/1999 | Mickelson | H01H 71/121 335/167 |
| 5,892,428 A | * | 4/1999 | Hsu | H01H 61/02 337/318 |
| 7,135,953 B2 | * | 11/2006 | Leitl | H01H 71/7436 335/145 |
| 7,518,482 B2 | * | 4/2009 | Fleege | H01H 71/16 337/36 |
| 2009/0115556 A1 | * | 5/2009 | Faik | H01H 71/7463 335/42 |
| 2010/0238611 A1 | * | 9/2010 | DeBoer | H01H 71/0271 361/634 |
| 2014/0176293 A1 | | 6/2014 | Melecio et al. | |

* cited by examiner

*Primary Examiner* — Anthony Haughton
(74) *Attorney, Agent, or Firm* — Locke Lord LLP

(57) ABSTRACT

An overload relay is provided for electrical equipment, such as a motor. The overload relay includes a set of electrical contacts, a trip mechanism and a single-arm, a set of monolithic compliant mechanism actuators. The trip mechanism has a normal position and a tripped position. The normal position allows electrical connection between the electrical contacts, and the tripped position interrupts electrical connection between the electrical contacts in response to detection of a high current condition. The single-arm actuator is formed of an electrically conductive material, and includes a compliant hinge and a single bar connected to the hinge. The single bar is electrically coupled to the line contact or the load contact. Under the high current condition, one of first and second ends of the single bar deflects relative to the compliant hinge to cause the trip mechanism to move into the tripped position.

15 Claims, 6 Drawing Sheets

THERMAL-MECHANICAL FLEXIBLE OVERLOAD SENSOR

FIELD

The present disclosure is related to a monolithic thermal-mechanical flexible sensor and actuator for an overload relay.

BACKGROUND

An overload relay is used to protect electrical equipment, such as, for example, motors, controllers and branch-circuit conductors, from current overload. The overload relay is connected between a power source and the electrical equipment. When an overload condition exists, the overload relay opens electrical contacts (e.g., normally closed (NC) contacts) to interrupt power to the equipment via a contactor or other circuit interrupter. The overload relay can also include other electrical contacts (e.g., normally open (NO) contacts), which are closed to turn on an alarm in response to the overload condition.

There are different types of overload relays, such as a thermal overload relay, melting alloy overload relay, bimetallic overload relay, and magnetic current relay. An overload relay can include a sensing element to detect a current overload condition (e.g., a high current condition or over current condition) and an actuating element to actuate a trip mechanism which opens the electrical contacts, such as normally closed (NC) contacts, when a current overload condition is detected by the sensing element. Some overload relays use a heating coil as the sensing element and a bimetallic strip as the actuating element for each current phase. The bimetallic strip has the heating coil wound directly thereon. The heating coil is a conductor which is connected to receive current (e.g., one phase of the current) that flows to the electrical equipment. In operation, the heating coil is heated by current flow therethrough. The bimetallic strip is configured to deflect and actuate the trip mechanism to open the electrical contacts when the bimetallic strip is heated by the heating coil at or above a threshold temperature which reflects a current overload condition, e.g., a high current condition.

Accordingly, these types of overload relays require at least two or more parts for the sensing and actuating elements (e.g., a heating coil and a bimetallic strip), thereby increasing complexity of assembly, potential frictional failure due to the contact of two parts, and overall costs. Such overload relays also require a substantial amount of materials for the sensing and actuating elements and require substantial current calibration.

SUMMARY

The present disclosure is directed to an overload relay for use in the protection of electrical equipment, such as motors, controller and branch-circuit conductors. Specifically, the overload relay incorporates a single-arm, monolithic compliant mechanism actuator (CMA) to detect a high current condition (e.g., a current overload condition or over current condition) for the electrical equipment and to cause a trip mechanism to open electrical contacts (e.g., normally closed (NC) contacts) in response to the detected high current condition. When the electrical contacts are opened, the power supplied to the electrical equipment is interrupted, via a contactor or other circuit interruption device. The actuator can replace a heating coil and bimetallic strip that are used as sensing and actuating elements in some thermal overload relays, such as TeSys® D Thermal Overload Relay manufactured by Schneider Electric.

The actuator can have a single arm that includes a mounting support, a single bar with a first end and opposing second end, and a compliant hinge connected between the mounting support and the single bar. The compliant hinge can have or be a flexure member, which is connected to the single bar between the first and second ends of the single bar. The single bar is electrically coupled to a line side (e.g., power source) or a load side (e.g., the electrical equipment). In an example operation, one of the first and second ends (e.g., a free end) of the single bar deflects relative to the compliant hinge as a result of the high current condition, which in turn causes the trip mechanism to open the electrical contacts in order to interrupt power to the electrical equipment. The overload relay can include an actuator for each current phase of a multi-phase power source.

Accordingly, an overload relay can be designed and constructed with a single-arm, monolithic compliant mechanism actuator that performs the functions of the sensing and actuating elements while reducing overall energy loss. The overload relay requires less overall parts and materials, which further allow for a more simplified assembly process and current calibration process and for reduced overall costs. The actuator is configurable to detect a predetermined high current condition and to deflect under such condition, through the design of a shape and dimension as well as the thermal profile of the actuator, and the material(s) used to fabricate the actuator. The actuator can also be formed from a conductive material, such as aluminum or any other conductive metal with a high thermal expansion coefficient.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

A single-arm, monolithic compliant mechanism actuator (CMA) is disclosed for use in an overload relay, and is configured to detect a high current condition (e.g., a current overload condition or over current condition) for electrical equipment and to cause a trip mechanism to open electrical contacts, e.g., normally closed (NC) contacts, in response to the detected high current condition. When the NC contacts are opened, the power supplied to the electrical equipment is interrupted, via a contactor or other circuit interruption device. Furthermore, the overload relay can include other types of electrical contacts, such as normally open (NO) contacts, which are closed when the trip mechanism is tripped by the high current condition. The NO contacts can be used to control an alarm to identify the status of the overload relay, or other devices. Both the NO and NC contacts can have a stationary electrical contact, and a movable electrical contact, which is maintained on a movable contact carrier (e.g., a slider). The movable contact carrier is movable between a normal position and a tripped position to open and close the electrical contacts of the NO and NC contacts.

The actuator is an electro-thermal compliant mechanism that includes a mounting support, a single bar (e.g., a hot bar), and a compliant hinge connected between the mounting support and the single bar. The compliant hinge is a flexure member, which is connected to the single bar between the ends of the single bar. The single bar is electrically coupled to a line side (e.g., power source) or a load side (e.g., the electrical equipment), and deflects relative to the compliant hinge as a result of a thermal force generated from the high current condition. An example of the actuator and its operations will be described in further detail below with reference to the Figures.

Figure 1:
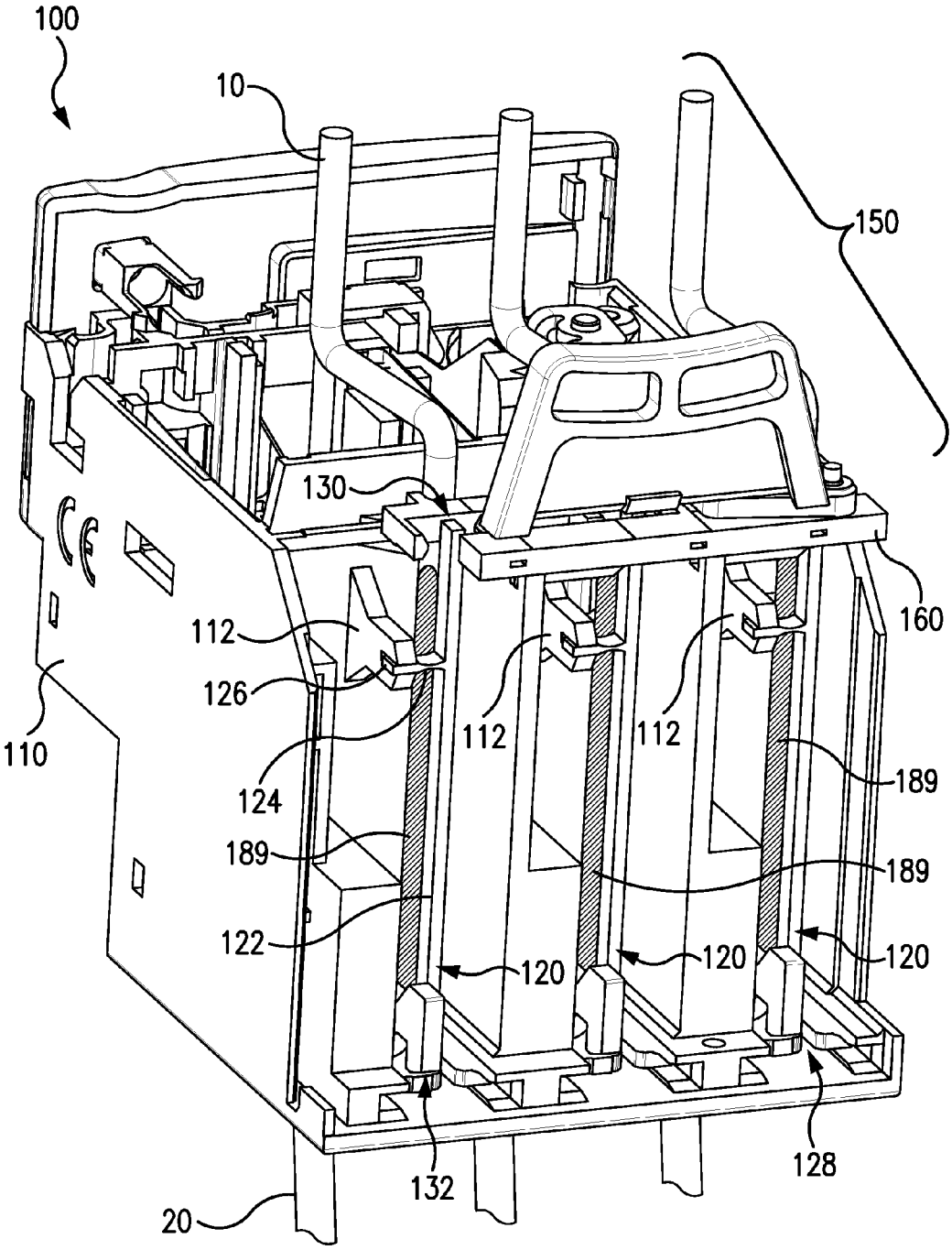
FIG. 1 illustrates a perspective front view of an example of a 3-pole overload relay with a set of single-arm monolithic compliant mechanism actuators (CMA) in accordance with an embodiment of the present disclosure.
Figure 2:
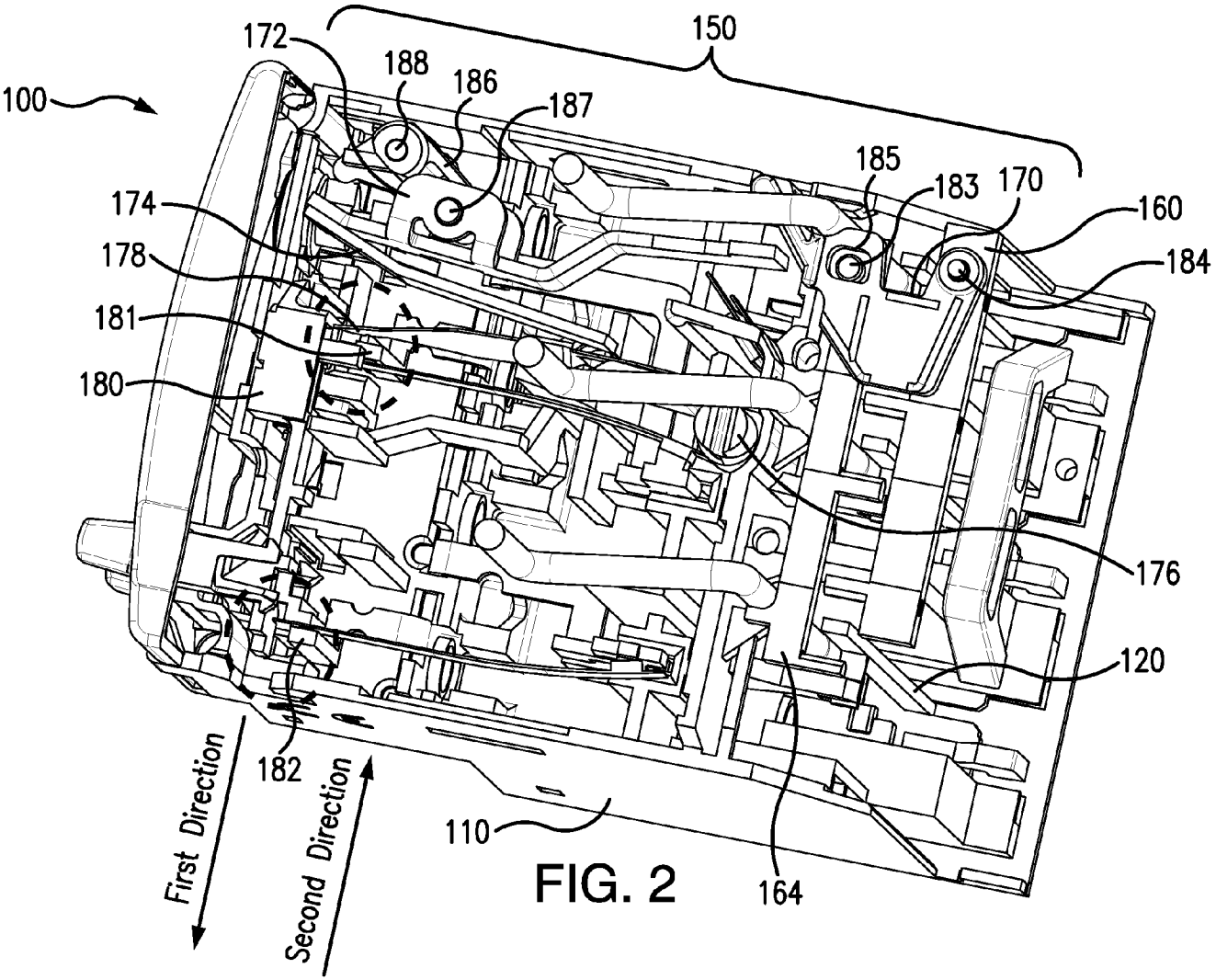
FIG. 2 illustrates a perspective top view of the overload relay of FIG. 1, including a trip mechanism and electrical contacts.

Turning to FIGS. 1 and 2, perspective front and top views of an overload relay 100 are shown. The overload relay 100 includes one or more single-arm monolithic compliant mechanism actuators 120 and a trip mechanism 150, which are housed along with other mechanical and electrical components in a casing 110. The trip mechanism 150 can be a trip mechanism with a shifter 160, as further explained below, such as found in some thermal overload relays, including TeSys® D Thermal Overload Relay manufactured by Schneider Electric. In this example, an actuator 120 is provided for each separate current phase (e.g., from a three phase power source) supplied to a load, such as electrical equipment which can include a motor, controller, branch-circuit conductor, or other electrical equipment that employ an overload relay. The actuator 120 and its components can be electrically connected in series between a power line connection 10 or a load line connection 20.

Figure 3:
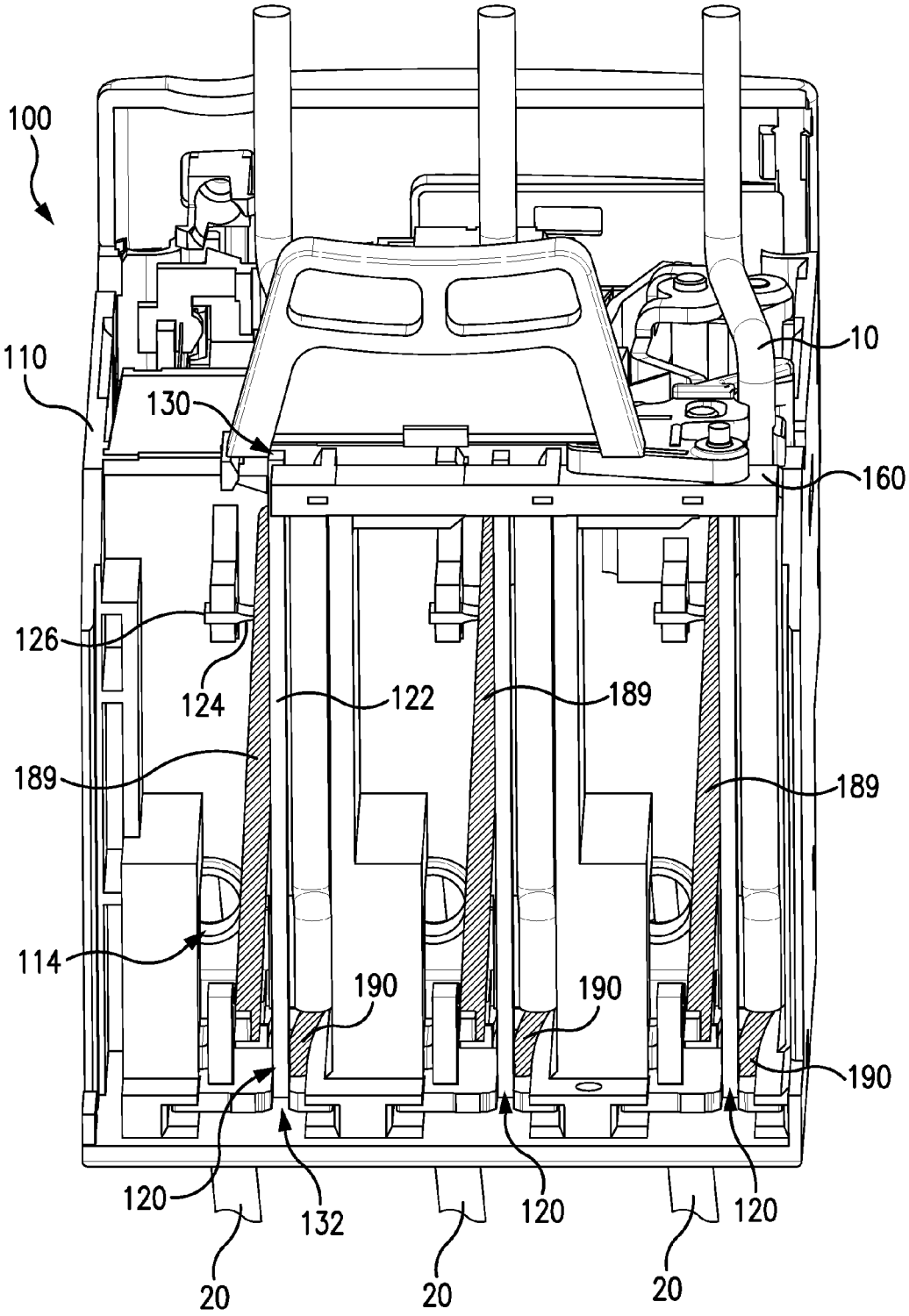
FIG. 3 illustrates a partial view of one side of the overload relay of FIG. 1, with the actuator electrically connected to a power line via a power line connection or a load side via a load line connection, or both.

For example, the actuator 120 is electrically connected on one end 132 by a wire 190 to a power line side via the power line connection 10 and on the opposite end 130 to a wire 189. The wire 189 is connected to the load line connection 20, with current flowing in the direction from the power line connection 10 to the load line connection 20. The connections 10 and 20 can include electrically conductive cables, and can also include electrical connector(s). In FIG. 3, each respective load line connection 20 can extend through a wire hole 114 to physically and electrically connect with the opposite end 132 of the actuator 120, enabling the current path.

Figure 5:
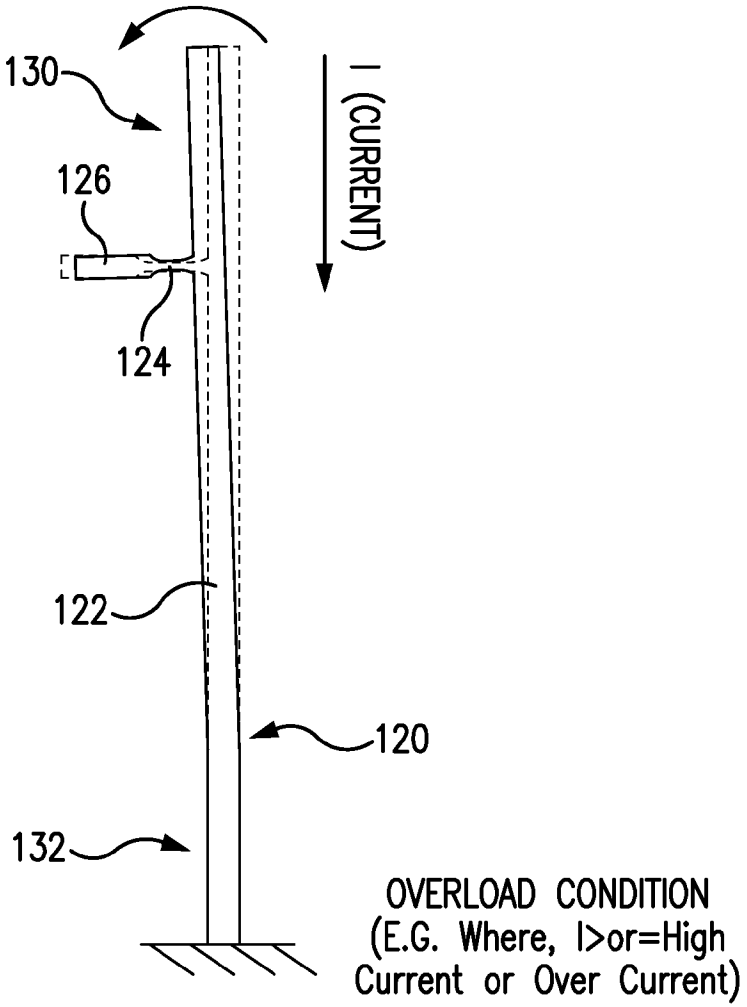
FIG. 5 illustrates an example of the actuator of FIG. 4, which is deflected from a current overload condition to a tripped state or position.
Figure 4:
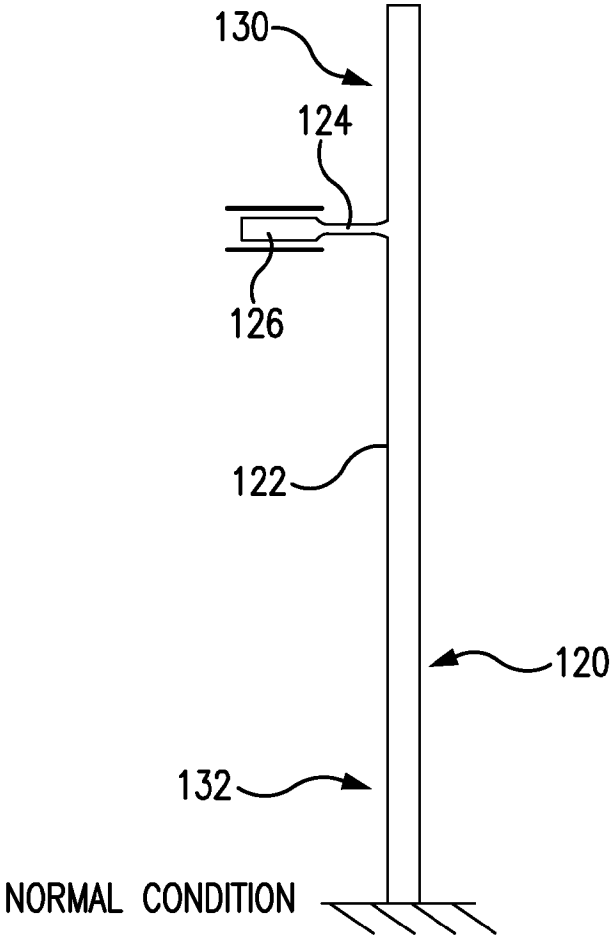
FIG. 4 illustrates an example of the actuator, such as in the overload relay of FIG. 1, in a normal state or position.

As shown in FIG. 2, there is one or more sets of electrical contacts in the overlay relay 100. For example, the electrical contacts include two visible sets of electrical contacts, e.g., 181 and 182, each having a stationary electrical contact and a movable electrical contact. The electrical contacts are connected to one or more terminals (not shown) of the overload relay 100. In this example, the electrical contacts 181 are normally open (NO) contacts and the electrical contacts 182 are normally closed (NC) contacts. The electrical contacts 181 and 182 are open and closed respectively at a normal position to provide for an electrical connection between their corresponding movable and stationary contacts and any conductors connected thereto. When the current flow through each of the actuators 120 reaches a high current condition (e.g., a current overload condition, an over current condition or a predefined high current condition), the actuators 120 deflects as a result of a thermal force due to heat generated from the high current running through them. This thermal deflection of a portion of the actuators 120, as further explained below, causes the trip mechanism 150 to close the electrical contacts 181 and open the electrical contacts 182 at a tripped position, thereby interrupting electrical connection between their respective movable and stationary electrical contacts. In this example, the actuators 120 are configured to deflect toward the left into a tripped state from the high current condition, as shown in FIG. 5. As shown in FIG. 4, the actuators 120 return to a normal state under normal conditions such as a normal current condition or when the actuators 120 and surrounding components cool down.

Figure 7:
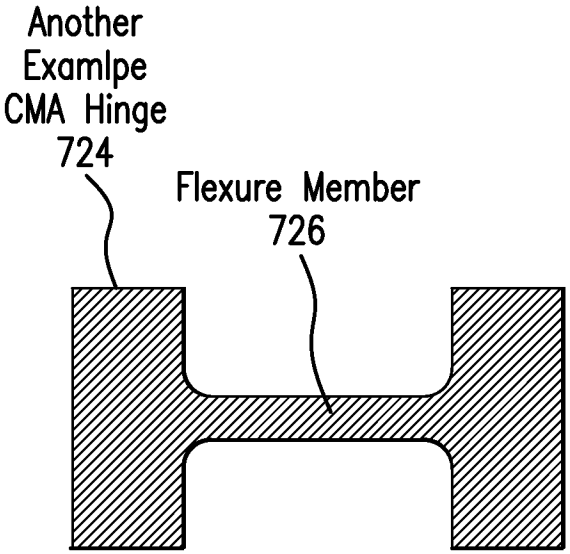
FIG. 7 illustrates another example of a compliant hinge of an actuator, such as in the overload relay of FIG. 1.
Figure 6:
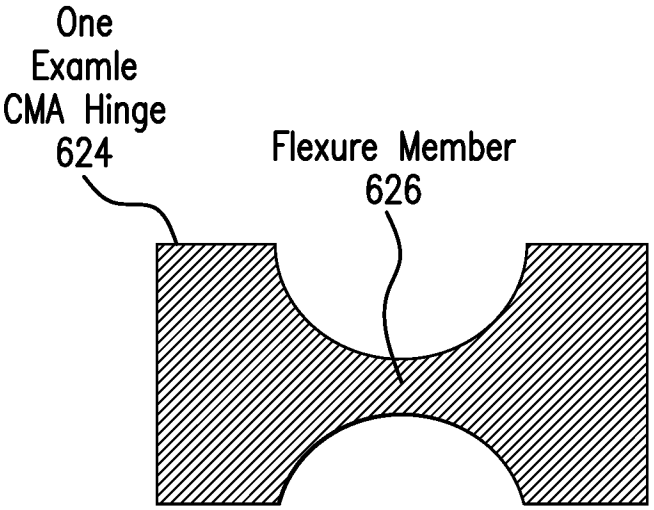
FIG. 6 illustrates an example of a compliant hinge of an actuator, such as in the overload relay of FIG. 1.

As shown in both FIGS. 4 and 5, the actuator 120 is a monolithic single-arm type actuator, and includes a single bar 122, a mounting support 126 and a compliant hinge 124 connected between the mounting support 126 and the bar 122. The bar 122 includes a first end 130 and a second end 132 which is opposite the first end 130. The first end 130 is a free end, which deflects (e.g., thermally deflects) under a high current condition, and the second, opposite, end 132 is fixed relative to the casing 110 (e.g., shown in FIG. 2). The compliant hinge 124 is a flexure member, which is connected to the bar 122 between the ends 130 and 132 of the bar 122. The compliant hinge 124 can have a substantially hour-glass shape (e.g., cross-section) such as shown by one exemplary compliant hinge 624 with a flexure member 626 in FIG. 6 and by another exemplary compliant hinge 724 with a flexure member 726 in FIG. 7.

Turning back to FIG. 1, the casing 110 includes various components for housing each of the actuators. For example, the casing 110 includes casing supports 112 for respective mounting supports 126 of the actuators 120, and casing grooves (or slots) 128 for receiving and fixedly holding respective ends 132 of the actuators 120. The supports 112 can be configured through their surface dimensions and spacing to allow rotational and/or translational movement of the mounting supports 126.

Figure 8:
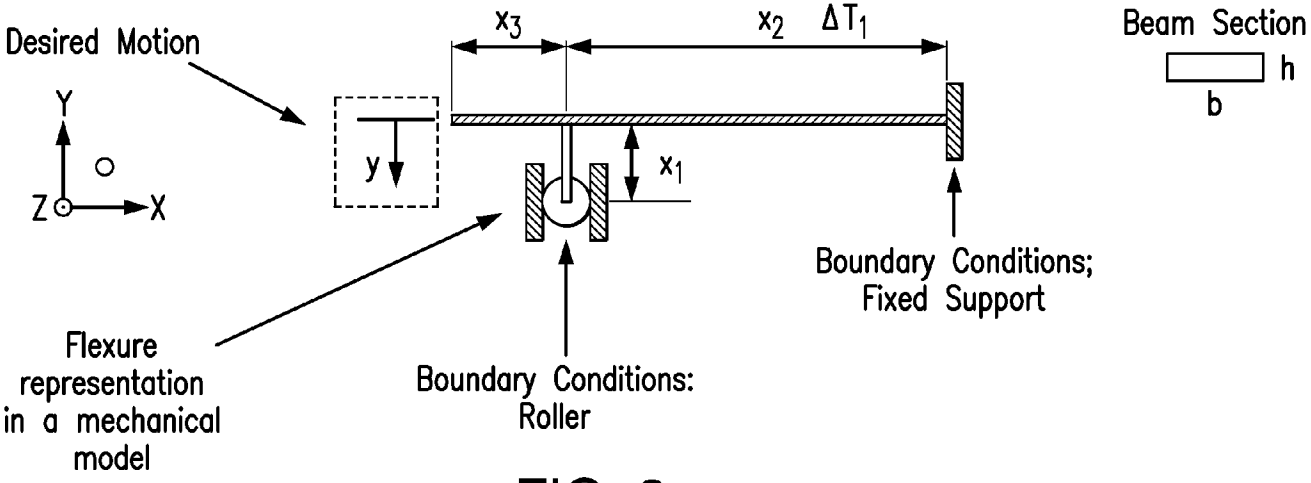
FIGS. 8-10 illustrate an exemplary model and operation of a single-arm monolithic compliant mechanism actuator.
Figure 10:
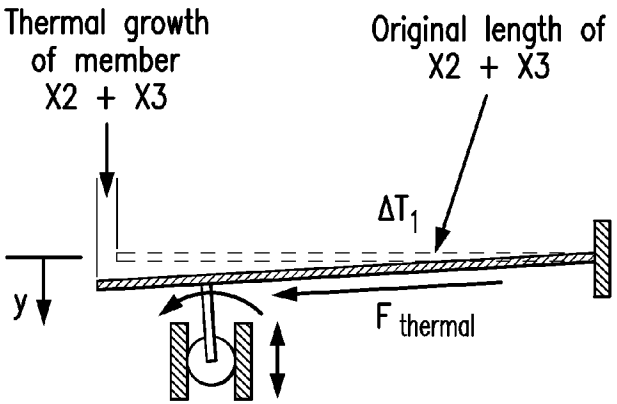
Figure 9:
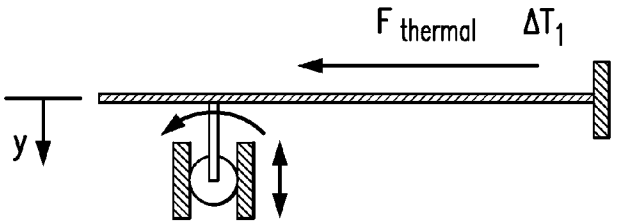

FIGS. 8-10 are provided to further explain thermal-mechanical aspects of a single-arm compliant mechanism, such as the actuator 120 of FIG. 1. As shown in FIG. 8, an exemplary single-arm compliant mechanism includes a flexure X1 and an arm which is part of the current path, (also referred to as a hot arm or hot bar) with portions X2 and X3. The hot arm extends along an x-axis (as marked). The flexure X1 extends along a y-axis, and is a pivot point, which allows the hot arm to bend along y direction of the plane x-y and then a vertical displacement over a y-axis. Specifically, a change in temperature $\Delta T_1$ in the portions X2 and X3 of the hot arm generates a thermal expansion of these portions in the x-axis, which in turn generates a thermal force $F_{thermal}$ (FIG. 9) which allows the portions X2 and X3 to bend. The portion X3 of the hot arm is a rigid body arm which has an end (e.g., a tip) connectable to a trip mechanism of an overload relay, such as the overload relay 100 described herein.

In this exemplary model design, there are two boundary conditions, such as defined by a fixed support and a roller type support. The fixed support holds one end of the hot arm, in this case an end of the portion X2 (e.g., 132 of FIG. 1). The roller type support constrains its translation an end of the flexure X1 (e.g., 126 of FIG. 1), with at least a portion thereof which acts as a roller and is free to rotate and translate along a surface (e.g., 112 of FIG. 1) upon which the end rests. In order to achieve the optimal constraint, the surface can be horizontal, vertical or sloped at any angle. In operation, the flexure X1 expands and contracts with the temperature changes $\Delta T_1$, such as between a normal state shown in FIG. 9 and a tripped state (e.g., deflected state) shown in FIG. 10. In this example, the resulting reaction force ($F_{thermal}$) is a single force that is perpendicular to, and away from, the surface. It should be understood that the x-y coordinates as marked on the drawing are used herein simply for the purposes of explanation. The actuator and its components can be oriented in a different fashion.

Accordingly, a single-arm compliant mechanism actuator can be configured to deflect in a predefined direction with a predefined amount of force at a predefined temperature and/or current condition according to various factors, including but not limited to the location, dimension and shape of the supports (e.g., in the relay casing) which define the boundary conditions as well as the dimension, shape and electrical/heat conductive materials of the flexure, the portions X1 and X2 of the hot arm, and the location of the pivot point (e.g., the location of the flexure along the hot arm).

Furthermore, the actuator described herein can be used in combination with various types of trip mechanisms for use in an overload relay, including those which utilize a shifter, for example, as generally known in the art and used in the TeSys® D OLR cited above. For example, turning back to FIG. 2, the trip mechanism 150 can include shifter 160, lever 170, compensation bimetal support 172, a compensation bimetal 174, compensator lever 176, bistable spring 178, and movable contact carrier 180. The shifter 160 can include two displacement bars, e.g., a first displacement bar 162 and second displacement bar 164. The movable contact carrier 180 can be a slider, which carries one or more movable electrical contacts, such as the movable electrical contacts from each of the sets of visible electrical contacts 181 and 182 (e.g., NC contacts). The lever 170 is attached to the shifter 160 at two points. For example, at a first point, the lever 170 is movably connected on a pin 183 on one end of the first displacement bar 162 to allow rotational movement. At a second point, the lever 170 has a slot area 185 in which a pin 184 of the second displacement bar 164 is movably arranged. In this way, the lever 170 moves relative to the movement of the shifter 160, which moves according to the position of the end 130 of the actuators 120 (e.g., normal state or tripped state). The translation motion of the shifter 160 is transferred throughout the lever 170 to the compensation bimetal support 172. The compensation bimetal support 172 is attached to the compensation bimetal 174 preventing relative motion between these two bodies because they are bonded together. The compensation bimetal support 172 is assembled to the compensation lever 186 with a pin joint 187 allowing rotation of the compensation bimetal support 172.

The compensator lever 176 is assembled to the case 110 also with a pin joint 188, which allows rotation of the compensator lever 176. Once motion is transmitted to the compensation bimetal 174 and the compensation bimetal support 172 by the compensator lever 176, they rotate and push against the bistable spring 178. The bistable spring 178 has energy stored and is resting in one of the two bistable positions. When the bistable spring 178 receives the push force, it releases the stored energy and changes to a second state. When the bistable spring 178 changes from one position to the second bistable position, it causes the movable contact carrier 180 to move in a first direction from the normal position with the electrical contacts 181 and 182 in the normal position (e.g., normally open and normally closed, respectively) to a tripped position in which the electrical contacts 181 and 182 are closed and opened respectively. When the actuators 120 cool down and the normal conditions return, the actuators 120 return back to a normal state and the movable contact carrier 180 can be moved in a second direction back to the normal position.

The overload relay (e.g., 100) and its components are provided as an example. The overload relay can have a single-arm monolithic compliant mechanism actuator per pole, as described herein, depending on the power configuration to be monitored, such as the number of phases, the use of a neutral, or a combination thereof. The components of the single-arm actuators can also be configured with different dimension and materials, with the bar or other portions deflecting according to a predefined temperature profile or predetermined high current condition in order to trip the trip mechanism in the overload relay. The actuator can also be formed using any suitable thermally and electrically conductive material(s), such as aluminum or any other conductive metal with a high thermal expansion coefficient.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention."

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. An overload relay for electrical equipment, the overload relay comprising:

a set of electrical contacts;

a trip mechanism having a normal position and a tripped position, the normal position allowing electrical connection between the set of electrical contacts, the tripped position interrupting electrical connection between the set of electrical contacts in response to detection of a high current condition in order to interrupt power to the electrical equipment; and a single-arm, monolithic compliant mechanism actuator formed of an electrically conductive material, the actuator including:

a mounting support, a compliant hinge comprising a flexure member, and a single bar connected to the compliant hinge with the flexure member connected between the mounting support and the single bar, the single bar having a first end and an opposing second end, the single bar being electrically coupled to a line side or a load side, the single bar having one of the first and second ends deflectable relative to the compliant hinge under the high current condition to cause the trip mechanism to move to the tripped position, wherein the single bar is a hot bar that extends along a single axis.

2. The overload relay of claim 1, wherein the one of the first and second ends returns back to a normal state from a tripped state, under a normal condition.

3. The overload relay of claim 1, wherein the actuator is formed from aluminum.

4. The overload relay of claim 1, wherein the compliant hinge is connected to the single bar between the first end and the second end of the single bar.

5. The overload relay of claim 1, further comprising a casing to house the trip mechanism and the actuator, one end of the first and second ends of the single bar being fixed relative to the casing and the other of the first and second ends being free to deflect under the high current condition.

6. The overload relay of claim 1, wherein the dimensions of the single bar is selected based on a predetermined high current condition.

7. The overload relay of claim 1, wherein the single bar is electrically connected in series to a power line connection or a load line connection.

8. The overload relay of claim 1, wherein the set of electrical contacts comprises a stationary electrical contact and a movable electrical contact, and wherein the trip mechanism includes:

a movable contact carrier for the movable electrical contact; and a shifter operatively coupled to the movable contact carrier, the shifter being moved by deflection of one of the first and second ends of the single bar from the high current condition to cause the movable contact carrier to open the electrical connection between the stationary and movable electrical contacts.

9. The overload relay of claim 8, wherein the actuator comprises a plurality of the actuators, each of the plurality of the actuators electrically coupled to receive one phase of a multiphase current produced from the power source and having one of the first and second ends engaged to move the shifter when deflected from the high current condition.

10. The overload relay of claim 1, wherein the single bar is electrically connectable between a load line connection or a power line connection to allow current flow in a direction from a deflecting one of the first and second ends of the single bar toward the other of the first and second ends of the single bar.

11. The overload relay of claim 1, wherein the compliant hinge has a substantially hour-glass cross section.

12. An actuator for an overload relay with a trip mechanism, the actuator being a single-piece formed of electrically conductive material and having a single arm comprising:

a mounting support;

a single bar having a first end and an opposing second end; and a compliant hinge having a flexure member connected between the mounting support and the single bar, the compliant hinge connected to the single bar between the first and second ends of the single bar, wherein one of the first and second ends of the single bar is deflectable relative to the compliant hinge under a high current condition to cause the trip mechanism to open an electrical connection between a set of electrical contacts in order to interrupt power supplied to electrical equipment, wherein the single bar is a hot bar that extends along a single axis.

13. The actuator of claim 12, wherein the compliant hinge is connected to the single bar between the first and second ends of the single bar.

14. The actuator of claim 12, wherein the actuator is formed of aluminum.

15. The actuator of claim 12, wherein the compliant hinge has a substantially hour-glass cross section.

* * * * *